United States Patent [19]

Kottmann

[11] 4,303,044

[45] Dec. 1, 1981

[54] ALUMINIUM 2-STROKE ENGINE CYLINDER AND CRANK CASE

[75] Inventor: Helmut Kottmann, Urbach, Fed. Rep. of Germany

[73] Assignee: Mahle GmbH, Stuttgart, Fed. Rep. of Germany

[21] Appl. No.: 191,756

[22] Filed: Sep. 29, 1980

[30] Foreign Application Priority Data

Nov. 16, 1979 [DE] Fed. Rep. of Germany ..... 2946317

[51] Int. Cl.[3] ..... F02B 75/02

[52] U.S. Cl. ..... 123/65 R; 123/41.69; 123/41.83; 123/41.84; 277/168; 277/236; 285/412; 285/DIG. 3

[58] Field of Search ..... 285/412, DIG. 3; 123/195 R, 41.69, 41.83, 41.84, 65 R; 277/4, 12, 168, 236

[56] References Cited

U.S. PATENT DOCUMENTS

| | | | |
|---|---|---|---|
| 826,146 | 7/1906 | Crane | 285/412 |
| 1,306,843 | 6/1919 | Wolgamott | 123/41.84 |
| 1,371,405 | 3/1921 | Wilkinson | 123/41.69 |
| 1,542,940 | 6/1925 | Hughes | 285/412 |
| 1,782,317 | 11/1930 | Royce et al. | 123/41.83 |
| 2,168,131 | 8/1939 | Mader | 123/65 R |
| 2,202,492 | 5/1940 | Jococks | 285/412 |
| 2,736,300 | 2/1956 | Flynn | 123/41.83 |
| 2,883,977 | 4/1959 | Langmaier | 123/41.69 |
| 3,168,081 | 2/1965 | Bauer | 123/41.84 |
| 3,767,216 | 10/1973 | Martin | 277/236 |

FOREIGN PATENT DOCUMENTS

| | | | |
|---|---|---|---|
| 165925 | 6/1921 | United Kingdom | 285/412 |

*Primary Examiner*—Robert I. Smith

*Attorney, Agent, or Firm*—Murray and Whisenhunt

[57] ABSTRACT

An aluminium 2-stroke engine cylinder and the crank case assembly is provided, in which a cylinder flange rests in sealing manner over its entire area upon a corresponding counter-surface of the crank case and a deformable packing lies between the sealing surfaces and in which the flange is tightened to the crank case by means of screws. The mutually opposite sealing surfaces of flange and crank case are slightly inclined in relation to one another in such a way that the distance between the sealing surfaces is greater radially inwards than radially outwards.

2 Claims, 2 Drawing Figures

ALUMINIUM 2-STROKE ENGINE CYLINDER AND CRANK CASE

BACKGROUND TO THE INVENTION

The invention relates an aluminium 2-stroke engine cylinder and the crank case assembly, in which a cylinder flange rests in sealing manner over its entire area upon a corresponding counter-surface of the crank case and a deformable packing lies between the sealing surfaces and in which the flange is tightened to the crank case by means of screws.

The tightening of the flange with screws upon the crank case frequently leads to a bending of the flange. As a consequence of this, distortions frequently occur in the working surfaces of the cylinder which are detrimental to the satisfactory running of the piston in the cylinder and can even, in individual cases, lead to piston seizing. The bending of the flange as described can be eliminated by a sufficiently stable construction. However, the reinforcements necessary for this purpose signify an undesired increase of the weight of the cylinder.

OBJECT OF THE INVENTION

The invention is therefore based upon the problem of avoiding, by measures other than those which increase weight, the distortions occurring in the working surfaces of the cylinder due to any bending of the flange.

SUMMARY OF THE INVENTION

According to the invention there is provided an aluminium 2-stroke engine cylinder and the crank case assembly, said cylinder having a flange resting in sealing manner over its entire area upon a corresponding counter-surface of the crank case including a deformable packing lying between the sealing surfaces, and screw means for tightening the flange to the crank case wherein the mutually opposite sealing surfaces of flange and crank case are slightly inclined in relation to one another in such a way that the distance between the sealing surfaces is greater radially inwards than radially outwards.

The inclination of the sealing surfaces necessary for the gap formation should expediently take place at an angle of 30 minutes. Experiments have shown that when the measure in accordance with the invention is utilised the distortion of the working surfaces of the cylinder, which occurred without this measure, can be reliably avoided.

BRIEF DESCRIPTION OF DRAWINGS

An example of embodiment is represented in the accompanying drawing wherein.

DESCRIPTION OF PREFERRED EMBODIMENT

Figure 1:
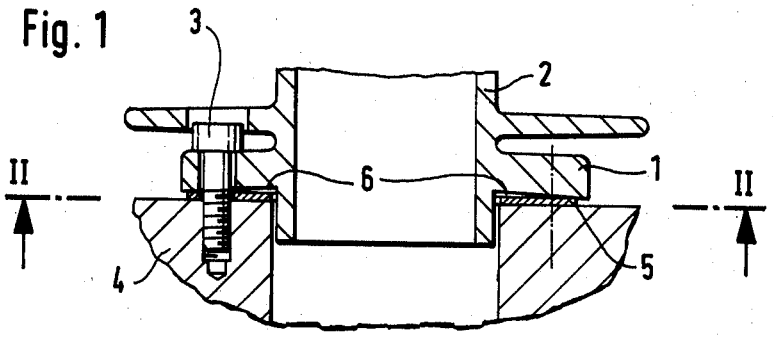
FIG. 1 shows a section through the connection in accordance with the invention.
Figure 2:
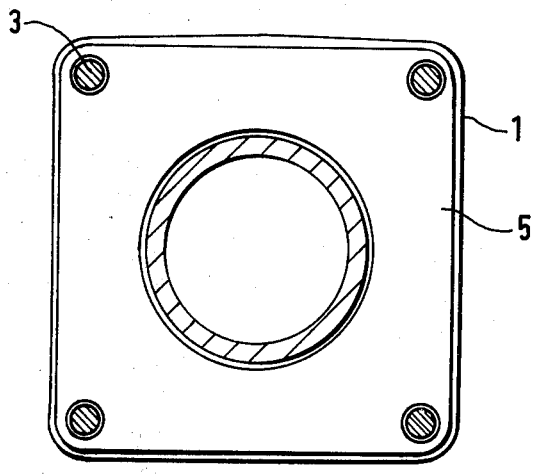
FIG. 2 shows a plan view of the cylinder flange.

The flange 1 of the cylinder 2 is tightened to the crank case 4 by means of screws 3. A deformable sealing material 5 lies between the flange and the crank case. When the cylinder is in the untightened condition a gap 6 forms between flange 1 and sealing material 5 at the internal circumference of the flange due to the very slightly oblique formation of the sealing surface of the flange. The inclination of the sealing surface of the flange 1 amounts to 30 minutes.

I claim:

1. An aluminium 2-stroke engine cylinder and the crank case assembly, said cylinder having a flange resting in sealing manner over its entire area upon a corresponding counter-surface of the crank case including a deformable packing lying between the sealing surfaces, and screw means for tightening the flange to the crank case, wherein the mutually opposite sealing surfaces of flange and crank case are slightly inclined in relation to one another in such a way that the distance between the sealing surfaces is greater radially inwards than radially outwards.

2. An engine according to claim 1, wherein the inclination between the two sealing surfaces amounts to about 30 minutes.

* * * * *